US008223085B2

(12) United States Patent
Mezger et al.

(10) Patent No.: US 8,223,085 B2
(45) Date of Patent: Jul. 17, 2012

(54) SENSOR ELEMENT FOR OPENING OF DOORS AND GATES

(75) Inventors: Klaus Mezger, Rehetobel (CH); Léon Audergon, St. Gallen (CH)

(73) Assignee: Bircher Reglomat AG, Speicher (CH)

( * ) Notice: Subject to any disclaimer, the term of this patent is extended or adjusted under 35 U.S.C. 154(b) by 727 days.

(21) Appl. No.: 12/094,781

(22) PCT Filed: Nov. 6, 2006

(86) PCT No.: PCT/EP2006/010603

§ 371 (c)(1), (2), (4) Date: May 21, 2009

(87) PCT Pub. No.: WO2007/059856

PCT Pub. Date: May 31, 2007

(65) Prior Publication Data

US 2009/0313897 A1 Dec. 24, 2009

(30) Foreign Application Priority Data

Nov. 25, 2005 (DE) ..... 10 2005 056 579

(51) Int. Cl.
*H01Q 19/30* (2006.01)
*E05F 15/20* (2006.01)

(52) U.S. Cl. ..... 343/819; 343/833; 343/834; 343/837; 49/25

(58) Field of Classification Search ..... 343/835, 343/815, 817, 818, 819, 833, 834, 836, 837; 340/522; 49/25
See application file for complete search history.

(56) References Cited

U.S. PATENT DOCUMENTS

| | | | | |
|---|---|---|---|---|
| 6,337,668 | B1 * | 1/2002 | Ito et al. | 343/833 |
| 6,407,719 | B1 | 6/2002 | Ohira et al. | |
| 6,515,635 | B2 | 2/2003 | Chiang et al. | |

FOREIGN PATENT DOCUMENTS

| | | |
|---|---|---|
| DE | 10012200 | 9/2001 |
| EP | 1508818 | 2/2005 |
| WO | WO 2005019859 A2 * | 3/2005 |

OTHER PUBLICATIONS

R. Schlub, D.V. Thiel, J.W. Lu and S.G. O'Keefe, Dual-band six-element switched parasitic array for smart antenna cellular communications systems, Electronic Letters, Aug. 3, 2000, vol. 36, No. 16.
M. Murata, K. Li and T. Matsui, Planar active Yagi-like antenna, Electronics Letters, Nov. 9, 2000, vol. 36, No. 23.

* cited by examiner

*Primary Examiner* — Dieu H Duong
(74) *Attorney, Agent, or Firm* — Bachman & LaPointe, P.C.

(57) ABSTRACT

A sensor element for opening of doors and gates, with the aim being to allow production of a detection field for identification of people and/or static objects by means of an antenna element, the antenna element is intended to have a flat antenna unit, with a pin-like antenna projecting at least approximately vertically from the flat antenna unit.

14 Claims, 3 Drawing Sheets

SENSOR ELEMENT FOR OPENING OF DOORS AND GATES

BACKGROUND OF THE INVENTION

The present invention relates to a sensor element for opening of doors and gates, in which case a sensing field can be generated using an antenna element for the purpose of detecting people and/or static objects.

Multifarious forms and designs of such sensor elements are known and available commercially. They are used to generate a sensing field in front of a door and/or gate area and are usually arranged above doors or gates. They are also usually in the form of stationary sensors, infrared sensors or radar sensors and detect stationary objects and/or people in the sensing field in front of a door in order to keep the latter open or to open it.

Since such sensor elements have to be adjustable or have to be adjusted to different heights and widths for particular door areas in order to generate an optimized sensing field for different heights and doors and gates of different widths, a complicated control device and adjusting devices have hitherto been provided on the sensor elements in order to adjust an angle of inclination of the sensor, for example, or to carry out optical adaptation or the like, which is undesirable.

For example, as a result of doors of different heights, the sensor element, in particular a radar sensor, is often set and readjusted after installation in order to set and align a sensing field to the conditions. The setting and alignment or adjustment operation is also time-consuming and expensive.

In particular, the operation of manually installing and aligning and adjusting sensing fields in front of doors and gates involves a high level of installation and alignment outlay, which is likewise undesirable.

EP 1 508 818 A exhibits a radar sensor in which individual slot antennas are provided in the carrier element.

US 2002/036595 A1 describes an antenna in which individual antennas are arranged at the same distance from one another. An antenna array is described in EP 1 113 523 A1, in which a plurality of pin antennas are likewise arranged at equal distances around an antenna element.

The publication by Schlub R. et al.: "Dual-band six-element switched parasitic array for smart antenna cellular communications systems" ELECTRONIC LETTERS, IEE STEVENAGE, GB, vol. 36, no. 16, 3 Aug. 2000 (2000 Aug. 3), pages 1342-1343, XP006015551 ISSN: 0016-5194" describes a conventional array antenna in which only individual arrays are provided in order to influence a field in different ways. Although some antennas may be arranged in different lengths, it is not possible to accurately determine a clear delimitation and boundary of a field.

The citation MURATA M ET AL.: "Planar active Yagi-like antenna" ELECTRONICS LETTERS, IEE STEVENAGE, GB, vol. 36, no. 23, 9 Nov. 2000 (2000 Nov. 9), pages 1912-1913, XP006015913 ISSN: 0013-5194 discloses an antenna in which the antennas are inserted into conductor tracks in a planar structure. Said antenna does not have any separate pins.

The present invention is based on the object of providing a sensor element for opening of doors and gates, in which the length and width of a sensing field can be exactly preset in order to ensure sufficient protection and a sufficient sensing field for opening of doors and gates for doors and gates of a particular width at an installation height or passage height which can be determined and selected.

In this case, the intention is to dispense with manual setting-up and readjustment, in which case only the sensor element has to be installed at a determinable height above or beside doors and gates in order to ensure an optimum sensing field in front of the door and/or gate.

SUMMARY OF THE INVENTION

This object is achieved by the features of a sensor element for opening of doors and gates, in which case a sensing field can be generated using an antenna element for the purpose of detecting people and/or static objects, characterized in that the antenna element has a flat antenna unit, at least one pin-like antenna projecting approximately perpendicularly from the flat antenna unit.

In the present invention, it has proved to be particularly advantageous to form an antenna element as a flat antenna unit, at least one antenna in the form of a pin antenna projecting from the flat antenna unit itself.

The width of a sensing field can be defined by preferably arranging two or more individual pin antennas beside one another.

Reflectors which are correspondingly arranged above the antenna and directors which are arranged below the antenna additionally make it possible to exactly determine and align a length of the sensing field on a background for a predefined installation height.

The sensor element is thus individually aligned for the required installation situation as regards the width and height of the gate or door by means of the corresponding pin-like arrangement and dimensioning.

In this case, the antenna, the reflector and the director are preferably arranged above one another and project perpendicularly from a reference plane of the flat antenna unit.

Appropriate selection of a length of the reflector, antenna and director makes it possible to exactly define and restrict the field of the antenna. In this case, the scope of the present invention should also include the fact that a plurality of arrangements of the reflector, antenna and underlying director are arranged beside one another, a width of the sensing field being able to be determined and aligned using a distance between two or more antennas, in particular underlying director are arranged beside one another, a width of the sensing field being able to be determined and aligned using a distance between two or more antennas, in particular two or more arrangements of the reflector, antenna and director.

A plurality of sensing fields of different sizes and widths can also be generated by using a plurality of arrangements which can also be connected to one another below one another. This should likewise be within the scope of the present invention.

The practice of producing different lengths of the sensing field by varying different lengths of the individual reflectors or antennas and directors should also likewise be considered. The invention shall not be restricted to this.

The reflector, antenna and director are preferably above one another, in which case the fact that a plurality of reflectors can be arranged above the antenna in different arrangements and one or more directors may also be arranged below the antenna may also be considered. The invention shall not be restricted to this.

In this case, one or more receiving antennas may be provided beside the antenna. Only the transmitting antenna itself as well as the receiving antenna are electrically connected to a respective radio-frequency circuit. The reflector and director are preferably connected to ground, if necessary by means of additional circuits.

BRIEF DESCRIPTION OF THE DRAWINGS

Further advantages, features and details of the invention emerge from the following description of preferred exemplary embodiments and with reference to the drawing, in which.

DETAILED DESCRIPTION

Figure 1A:
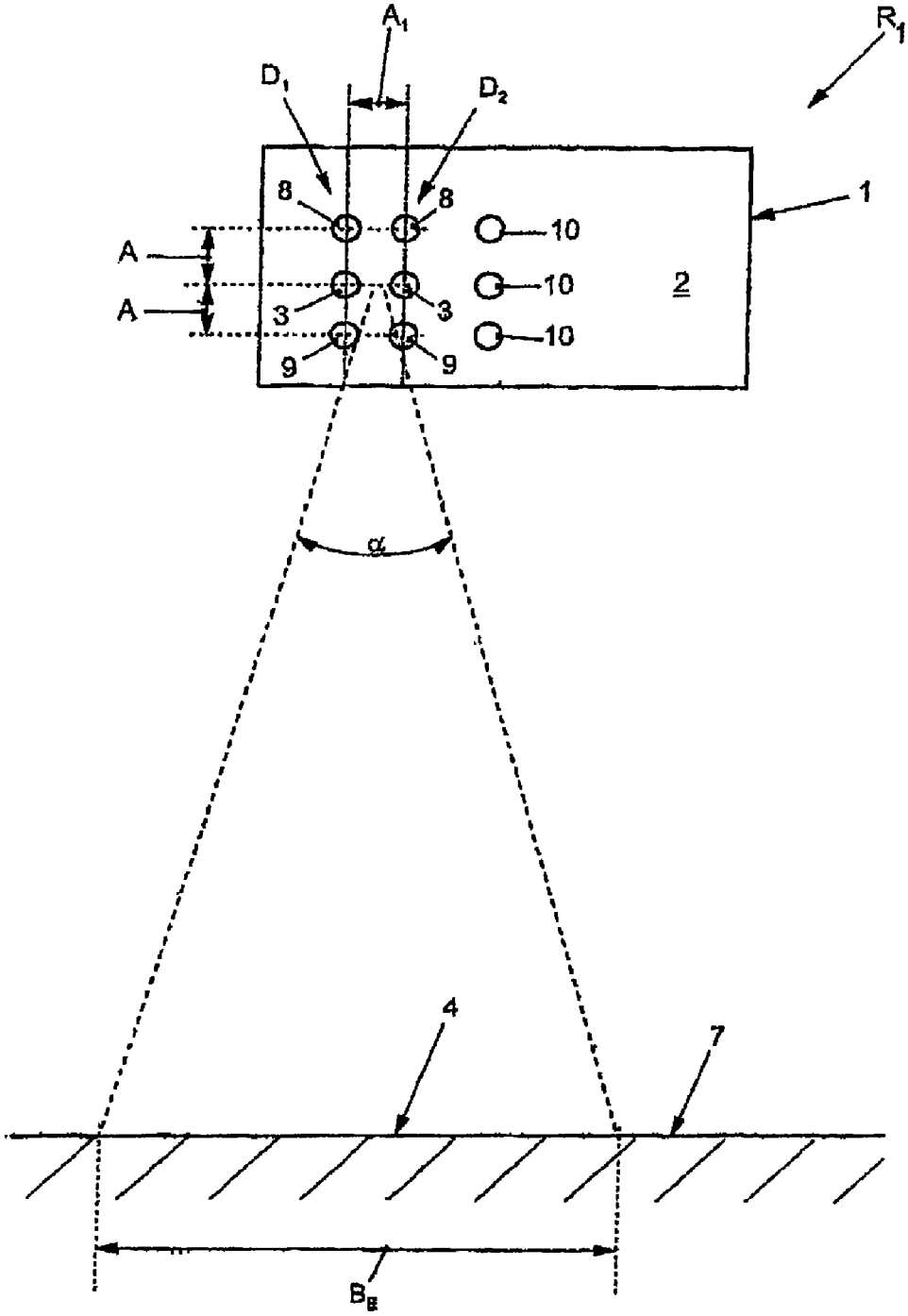
FIG. 1*a* shows a diagrammatically illustrated plan view of a sensor element for opening of doors and gates.

According to FIG. 1*a*, a sensor element $R_1$ according to the invention has an antenna element 1 which is in the form of a flat antenna unit 2. In this case, pin-like antennas 3 which are preferably arranged beside one another project from a reference plane E of the flat antenna unit 2 which may be in the form of a flat base plate, printed circuit board, substrate or the like.

The antenna 3 preferably projects perpendicularly from the flat antenna unit 2, but also projects at an angle if necessary, and is electrically operated in order to generate a sensing field 4.

The at least one antenna 3 which is in the form of a pin is preferably installed orthogonal to the flat antenna unit 2 and is designed and dimensioned in a manner corresponding to a Marconi antenna, in particular is in the form of an asymmetrical $\lambda/4$ dipole. The antenna 3 is preferably electrically operated actively as the actual antenna in order to generate the sensing field 4.

Figure 1B:
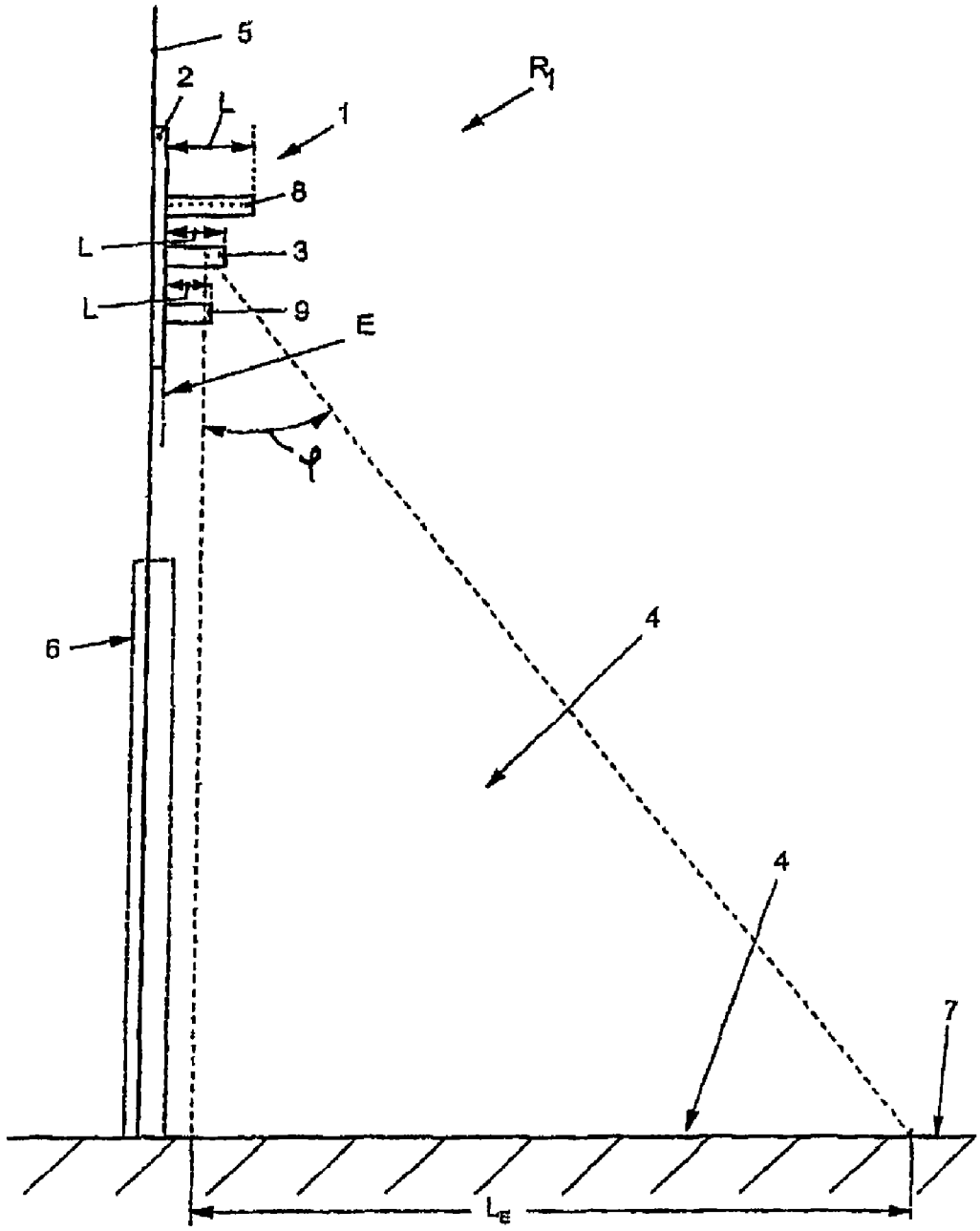
FIG. 1*b* shows a diagrammatically illustrated side view of the sensor element in the installed state according to FIG. 1*a;*

The antenna 3 may be installed, for example, on a wall 5 or above a door 6 or gate or else at any other desired locations. It illuminates a sensing field 4 which, as shown in FIGS. 1*a* and 1*b*, may extend from the door 6 to the floor 7, for example. The contour of the sensing field 4 may be of any desired type and size.

In order to determine and set a length $L_E$ of the sensing field 4, it has proved to be advantageous in the present invention to arrange at least one reflector 8 above the antenna 3.

In order to also limit the field in order to obtain a desirable "endfire" characteristic, at least one director 9 may be arranged in a pin-like manner below the antenna 3. The reflector 8 and director 9 are likewise of pin-like design, the reflector 8 and director 9 preferably lying on a common vertical to the antenna 3, as shown in the exemplary embodiment according to FIG. 1*a*.

The reflector 8 and director 9 are preferably connected to ground directly or indirectly, if necessary by means of an additional circuit. The reflector 8 and director 9 are likewise of pin-like design and analogously project approximately perpendicularly from the antenna 3. Like the antenna 3 as well, the reflector and director may likewise have a round, oval, square or polygonal cross section and preferably project perpendicularly from the flat antenna unit 2.

However, the scope of the present invention should also include the fact that the antenna 3 as well as the reflector 8 and director 9 are oriented at an angle, that is to say greater or less than 90°, to the surface of the flat antenna unit 2 or project from the latter.

An opening angle $\phi$ with respect to the floor 7 can be set and determined by means of a corresponding length L of the reflector 8 relative to the antenna 3 and of the director 9 relative to the antenna 3 in order to set a desired length $L_E$ of the sensing field 4.

In this case, the length of the reflector 8 may be less than, equal to or greater than a length of the antenna 3. The same applies to the director 9. As is also clear from FIG. 1*a* of the present invention, a width $B_E$ of the sensing field 4 of the sensor element $R_1$ can be determined by virtue of the fact that a plurality of arrangements $D_1$, $D_2$ comprising the reflector 8, the underlying antenna 3 and the director 9 arranged below the latter are preferably at a distance $A_1$ from one another on a vertical.

A width $B_E$ of the sensing field 4 and/or a width angle $\alpha$ can be set or changed, in particular by virtue of the distance between the two antennas 3 in the arrangements $D_1$, $D_2$.

In this case, it is not absolutely necessary for the reflector 8 and director 9 to be provided or to be perpendicularly arranged above one another in a correspondingly vertical manner. They may also be arranged outside a vertical in order to produce, for example, a different size or contour of the sensing field 4. For example, one or the other director 9 or reflector 8 may be dispensed with or a plurality of reflectors 8 and/or directors 9 may be provided below and/or above the at least one antenna 3. This should likewise be within the scope of the present invention.

In addition, it is conceivable to set a horizontal distance A between the reflector 8 and antenna 3 and/or a distance A between the antenna 3 and director 9 as desired in order to influence the length $L_E$ and/or width $B_E$ of the sensing field 4 on the floor and/or to influence the opening angle $\phi$ and the width angle $\alpha$.

Furthermore, the antenna element 1, in particular the flat antenna unit 2, as indicated in FIG. 1*a*, may be assigned at least one receiver antenna 10 which is preferably arranged beside the arrangements $D_1$ and/or $D_2$ at the same height as the antenna 3 and/or reflector 8 and director 9. The receiver antennas 10 are preferably on a vertical parallel to the arrangement $D_1$ and/or $D_2$ and are in the form of perpendicularly projecting pins as a receiver antenna 10 on the same flat antenna unit 2. The receiver antennas 10 are preferably arranged at a lateral distance from the other antennas 3, the reflector 8 and the director 9.

Figure 2A:
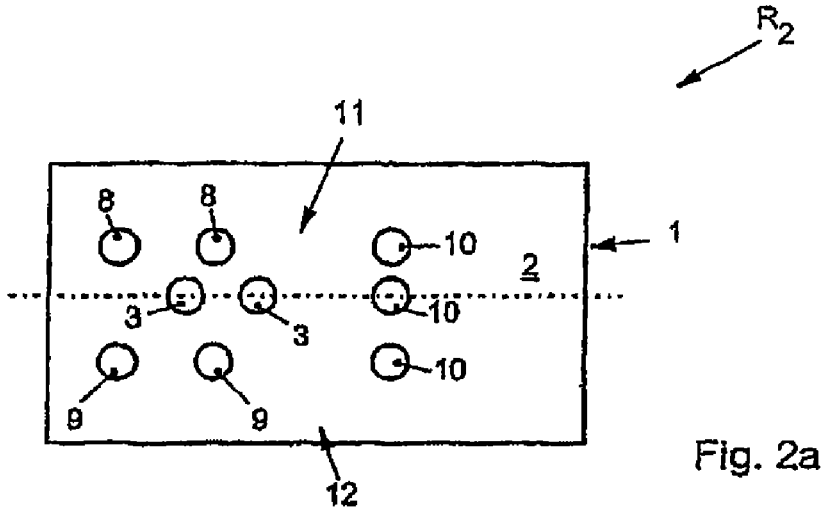
FIG. 2*a* shows a diagrammatically illustrated plan view of a further exemplary embodiment of a further sensor element according to FIGS. 1*a* and 1*b;*

A sensor element $R_2$ is shown in the exemplary embodiment of the present invention according to FIG. 2*a*, the antenna element 1 being in the form of a flat antenna unit 2, and reflectors 8 which are arranged in an area 11 above two antennas 3, which are on a horizontal and are at a distance from one another, and are arranged in any desired area 11 above the antennas 3 being provided. They need not necessarily be arranged on a vertical to the antenna 3.

In this case, at least one director 9 can also be provided in an area 12 below the at least one antenna 3. This should likewise be within the scope of the present invention. A plurality of receiver antennas 10 may be provided in the flat antenna unit 2 at a distance from the arrangement of the antenna 3 as well as the reflector 8 and director 9.

Figure 2B:
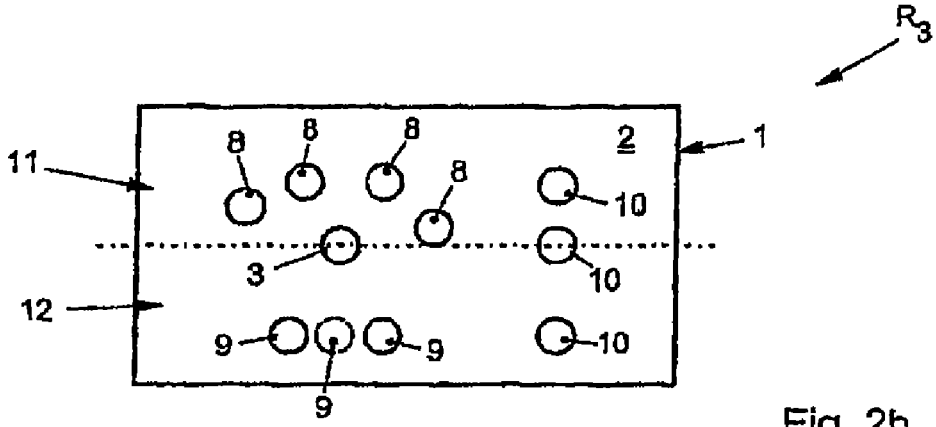
FIG. 2*b* shows a diagrammatically illustrated plan view of a further exemplary embodiment of the sensor element according to FIGS. 1*a* and 1*b;*

A sensor element $R_3$ which approximately corresponds to the abovementioned type is shown in another exemplary embodiment of the present invention according to FIG. 2*b*. The difference is that only one antenna 3 or else a plurality of antennas 3 (not illustrated in any more detail in this case) may also be provided, for example, a plurality of reflectors 8 being able to be provided in an area 11 above the antenna 3 and a plurality of directors 9 being able to be provided in an area 12 below the antenna 3 in any desired arrangement. These are used to focus the field, in particular the sensing field 4.

In this case, a length L of the individual antennas 3 and/or reflectors 8 and/or directors 9 may also vary in a corresponding manner. The same applies to their cross sections.

Figure 2C:
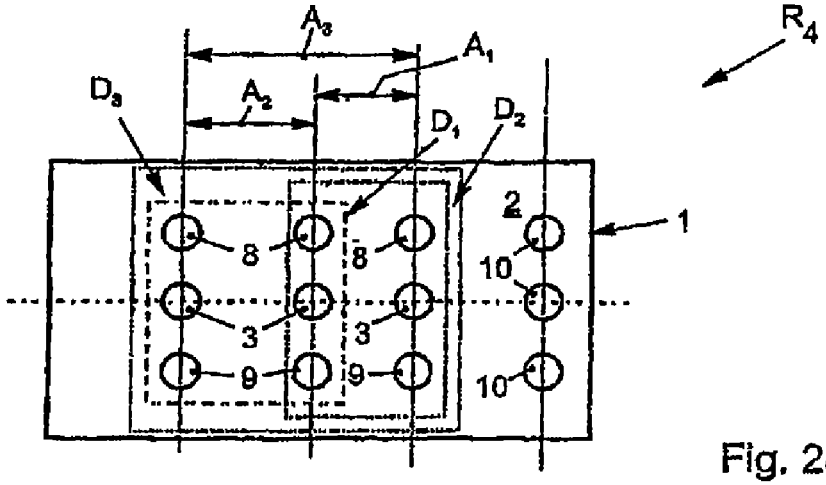
FIG. 2*c* shows a diagrammatically illustrated plan view of yet another exemplary embodiment of a sensor element according to FIGS. 1*a* and 1*b.*

A sensor element $R_4$, in which a plurality of arrangements $D_1$, $D_2$ and $D_3$ of the antenna 3, reflector 8 and director 9 are formed, is shown in the final exemplary embodiment of the present invention according to FIG. 2*c*.

In this case, in the preferred exemplary embodiment, the reflector 8, the underlying antenna 3 and the underlying director 9 are arranged above one another in the vertical direction according to the exemplary embodiment of the present invention 1*a* and 1*b*.

A corresponding further arrangement $D_2$ is provided beside it such that it is parallel to, and at a particular distance $A_1$ from, the arrangement $D_1$.

A particular distance $A_1$ is selected between the arrangements $D_1$ and $D_2$. In this case, a third arrangement $D_3$ comprising the reflector 8, the underlying antenna 3 and the underlying director 9 may be provided, which third arrangement is aligned at a different distance $A_2$ from the arrangement $D_1$ than the arrangement $D_2$.

This makes it possible to connect arrangements $D_1$ and $D_2$ at a selectable distance $A_1$ in order to obtain a desired sensing field 4. At the same time, it is conceivable for only the arrangements $D_1$ and $D_3$ to be connected to one another in order to generate a sensing field 4 with a correspondingly different opening angle $\phi$ and width angle $\alpha$ to the combination of arrangements $D_1$ and $D_2$.

It is also conceivable to connect the arrangements $D_2$ and $D_3$ together in order to generate yet another sensing field. This should likewise be within the scope of the present invention. This should also concomitantly include the fact that corresponding receiver antennas 10 are also provided on the antenna element 1 beside the individual arrangements $D_1$, $D_2$ and $D_3$.

Furthermore, as illustrated using dashed lines in FIG. 2*b*, a separate independent receiver antenna may also be assigned to the antenna element 1 or may be provided beside the latter. The invention shall not be restricted to this.

The invention claimed is:

1. A sensor element for opening doors and gates comprising:

an antenna means for producing a sensing field for detecting people and/or static objects, the antenna means has a flat antenna unit, at least one pin like antenna which projects from the flat antenna unit in a substantially perpendicular direction with respect to the flat antenna unit, a plurality of individual row arrangements, each comprising a reflector, an underlying antenna and an underlying director are provided on the flat antenna unit as projecting pins, and wherein the sensing field for a determinable field characteristic can be focused using a plurality row arrangement of a plurality of reflectors, antennas and directors above one another, wherein a distance between individual arrangements is able to be changed and set.

2. The sensor element as claimed in claim 1, wherein the reflectors and the directors are connected to ground.

3. The sensor element as claimed in claim 2, wherein at least one receiving antenna comprising a plurality of pins is formed beside an arrangement of the antenna.

4. The sensor element as claimed in claim 3, wherein the receiving antenna is analogously formed from correspondingly identical pins of the same dimensions, length and diameter as the adjacent arrangement of the reflector, antenna and director, the arrangement of the receiving antenna with its pins, which project approximately perpendicularly from the flat antenna unit, being analogously formed beside the arrangement of the reflector, antenna and director.

5. The sensor element as claimed in claim 4, wherein a broadening of the sensing field can be determined using the number of individual vertical arrangements of rows comprising respective antennas.

6. The sensor element as claimed in claim 5, wherein an opening angle ($\phi$) and thus a length of the sensing field can be set and determined using the distances between the arrangements and lengths of the reflectors with respect to the antennas and distances between the reflectors and the antennas.

7. The sensor element as claimed in claim 6, wherein a width of the sensing field can be set using the corresponding arrangement of a plurality of rows of the reflector, the underlying antenna and the underlying director.

8. The sensor element as claimed in claim 1, wherein corresponding changing-over between individual adjacent arrangements of the reflector, antenna and director can be switched or changed over with selectable distances and selectable lengths of the individual pins, and different widths of the sensing field can be set.

9. The sensor element as claimed in claim 1, wherein the antenna is in the form of an asymmetrical $\lambda/4$ dipole.

10. The sensor element as claimed in claim 1, wherein the flat antenna unit containing the reflector, antenna and director has one or more receiving antennas in the form of pins.

11. The sensor element as claimed in claim 10, wherein the flat antenna unit reflector and/or the antenna and/or the director is/are oriented at a selectable angle of greater than or less than 90° to the flat antenna unit.

12. The sensor element as claimed in claim 1, wherein the flat antenna unit is dimensioned for a frequency range of 10 to 100 GHz.

13. The sensor element as claimed in claim 1, wherein the flat antenna unit is dimensioned for a frequency range of 10 to 30 GHz.

14. The sensor element as claimed in claim 1, wherein the flat antenna unit is dimensioned for a frequency range of 24 GHz.

* * * * *